US008740024B2

(12) United States Patent
Steiner et al.

(10) Patent No.: US 8,740,024 B2
(45) Date of Patent: Jun. 3, 2014

(54) CLOSING PLATE AND SLIDING CLOSURE ON THE SPOUT OF A RECEPTACLE FOR MOLTEN METAL

(75) Inventors: Benno Steiner, Nebikon (CH); Werner Keller, Steinhausen (CH); Urs Truttmann, Baar (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 791 days.

(21) Appl. No.: 12/988,065

(22) PCT Filed: Apr. 17, 2009

(86) PCT No.: PCT/EP2009/002815

§ 371 (c)(1),
(2), (4) Date: Feb. 11, 2011

(87) PCT Pub. No.: WO2009/127420

PCT Pub. Date: Oct. 22, 2009

(65) Prior Publication Data

US 2011/0127302 A1 Jun. 2, 2011

(30) Foreign Application Priority Data

Apr. 17, 2008 (CH) ..... 603/08

(51) Int. Cl.
*B22D 41/28* (2006.01)
*B22D 41/14* (2006.01)
*B22D 41/00* (2006.01)
*B22D 37/00* (2006.01)

(52) U.S. Cl.
USPC ..... 222/597; 222/591; 222/598; 222/599; 222/600; 266/236

(58) Field of Classification Search
USPC ..... 222/591–607; 266/236
See application file for complete search history.

(56) References Cited

U.S. PATENT DOCUMENTS 4,582,232 A * 4/1986 Shapland et al. ..... 222/600

* cited by examiner

*Primary Examiner* — Lois Zheng
(74) *Attorney, Agent, or Firm* — Brian Roffe

(57) ABSTRACT

A closing plate for a sliding closure on the spout of a receptacle for molten metal, especially of a converter, includes an elongate refractory plate and a sheet metal jacket surrounding the same. The refractory plate has a sliding surface which can be braced with a sliding surface of a refractory closure plate interacting therewith or with a sliding surface of a refractory head part. The refractory plate has at least one tapering section which forms an angle with the sliding surface on at least one side delimiting the sliding surface, each tapering section being associated with a section of the refractory plate that projects beyond the sheet metal jacket. The closing plate reduces the risk of damage to the front faces of the refractory parts reduced during bracing of the parts with each other and/or during a relative adjustment of the refractory parts that are braced with each other.

20 Claims, 3 Drawing Sheets

CLOSING PLATE AND SLIDING CLOSURE ON THE SPOUT OF A RECEPTACLE FOR MOLTEN METAL

FIELD OF THE INVENTION

The invention relates to a closing plate for a sliding closure on the spout of a receptacle for molten metal, especially of a converter, that includes an elongate refractory plate and a sheet metal jacket surrounding the elongate refractory plate, the refractory plate being braceable with a sliding surface with this type or some other refractory closing plate or with a sliding surface of a refractory head part, and a sliding closure on the spout of a receptacle for molten metal, in particular of a converter, including the above closing plate.

BACKGROUND OF THE INVENTION

Sliding closures on the spout of receptacles for molten metal are known in a wide variety of embodiments. A sliding closure, which is used in particular to open and close a converter spout opening, is disclosed for example in EP 0 819 488 B1. It comprises a housing frame in which are disposed a stationary refractory closing plate (a so-called base plate) and a refractory sliding plate held in a sliding unit displaceable in relation to said closing plate. The sliding plate can be pressed sealingly with its upper sliding surface against a lower sliding surface of the base plate. The housing frame is fastened releasably to a base plate fixed to the receptacle, the base plate being braceable with its upper sliding surface with a refractory spout head part inserted into the base plate. During casting operation the refractory parts are subjected to a high degree of wear. It is therefore necessary to change them relatively frequently. For this purpose the housing frame must be respectively released from the base plate.

Since, as shown from experience, when using the sliding closure on the converter spout the base plate in particular wears very quickly, it is known from an earlier Swiss patent application No. 00603/08 to dispose moveably in the housing frame a case with at least two base plates in the housing frame, by means of the displacement a worn base plate being able to be removed from the operating position, and replaced by another base plate without the housing frame having to be removed from the base plate. In this way it is possible to maintain the casting operation for longer until the other refractory parts are also due to be changed.

The closing plates for a sliding closure are known to comprise a respective elongate refractory plate surrounded by a sheet metal jacket and which can also be in several parts.

OBJECTS AND SUMMARY OF THE INVENTION

The object forming the basis of the present invention is to provide a closing plate for a sliding closure on the spout of a receptacle for molten metal, in particular of a converter, which enables particularly gentle bracing with another closing plate or with a refractory spout head part. Furthermore, a sliding closure particularly suitable for converters is to be further improved.

This object is achieved according to the invention by a closing plate having a refractory plate with a tapering section that forms an angle with a sliding surface at least along one side delimiting the sliding surface and with the tapering surface being associated with a section of the refractory plate that projects beyond a sheet metal jacket, and by a sliding closure having a closing plate accommodated as a stationary base plate in a housing frame that can be attached to a base plate fixed to a molten metal receptacle and in which a sliding unit is disposed displaceably and provided with a sliding plate having a longitudinal axis extending in the direction of displacement of the sliding unit, and also the closing plate and its refractory plate are provided with the tapering section that is braceable with its sliding surface with a sliding surface of a refractory spout head part inserted into the base plate.

Further preferred embodiments of the closing plate according to the invention form the subject matter of the dependent claims.

With the closing plate according to the invention the risk of damage to the front faces of the refractory parts to be braced with each other when starting the bracing and/or during a relative displacement of the refractory parts to be braced with each other can be substantially reduced.

BRIEF DESCRIPTION OF THE DRAWINGS

In the following the invention is described in greater detail by means of the drawings. These show as follows.

DETAILED DESCRIPTION OF THE INVENTION

Figure 1:
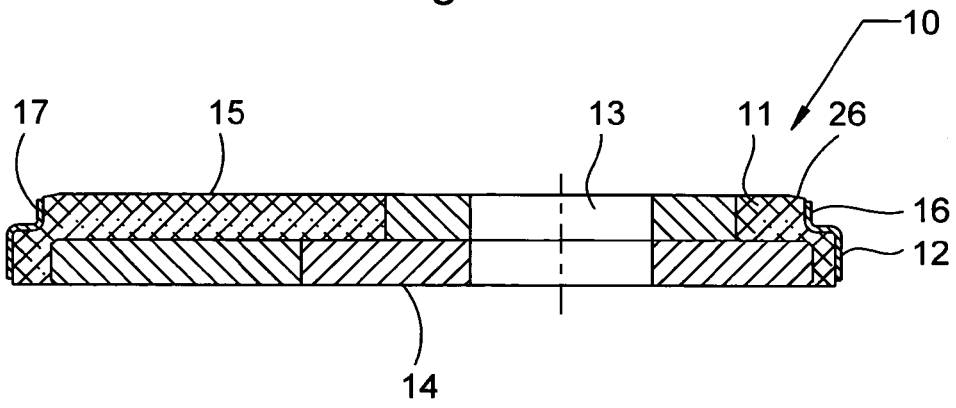
FIG. 1 is a longitudinal section of an exemplary embodiment of a closing plate according to the invention.
Figure 2:
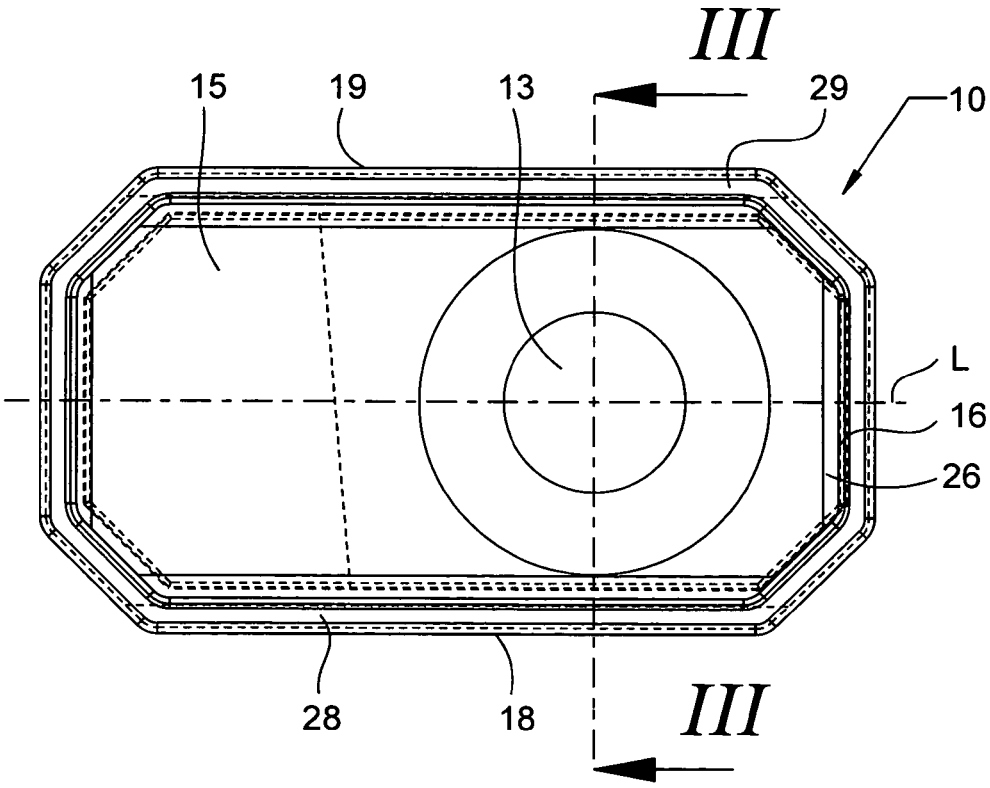
FIG. 2 is a top view of the closing plate according to FIG. 1.
Figure 3:
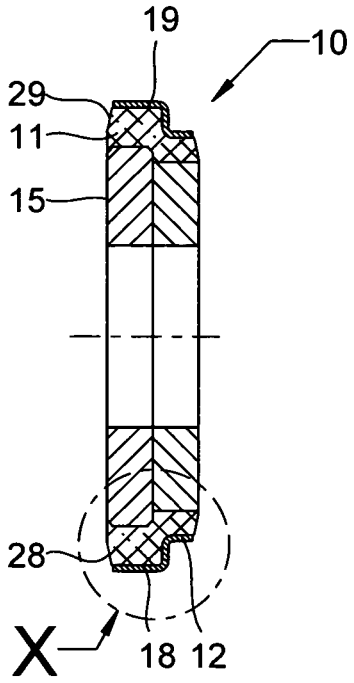
FIG. 3 is a section along line III-III in FIG. 2.
Figure 4:
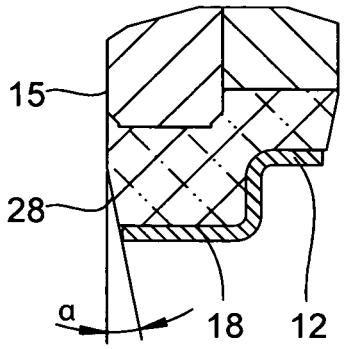
FIG. 4 is a detail X from FIG. 3 in an enlarged scale.

In FIG. 1 to FIG. 4 a closing plate 10 for a sliding closure on the spout of a receptacle for molten metal is shown. This can be, for example, a so-called base plate of a sliding closure 1 for a converter, shown in greater detail in FIGS. 5 to 7, as will be described in greater detail below. The closing plate 10 has an elongate form, and optionally an octagonal outer contour. It comprises a multi-part refractory plate 11 and a sheet metal jacket 12 surrounding the latter. The refractory plate 11 provided with a spout opening 13 has a lower sliding surface 14 and an upper sliding surface 15. The refractory plate 11 can on the one hand be braced with the lower sliding surface 14 with a sliding plate 20 of the sliding closure 1, and on the other hand with the upper sliding surface 15 with a lower sliding surface 21' of a refractory receptacle spout head part 21.

According to the invention the refractory plate 11 has in a section projecting beyond the sheet metal jacket 12 a tapering section 26 which forms an angle $\alpha$ with the sliding surface 15 at least along a side delimiting the sliding surface 15 along one of the two narrow sides 16, 17, the angle $\alpha$ preferably being between 10° and 15°. In addition, with the refractory plate 11 as well as the tapering section 26 a respective tapering section 29, 29 is provided with the sliding surface 14, these being associated with the two longitudinal sides 18, 19 parallel to the longitudinal axis L.

Figure 5:
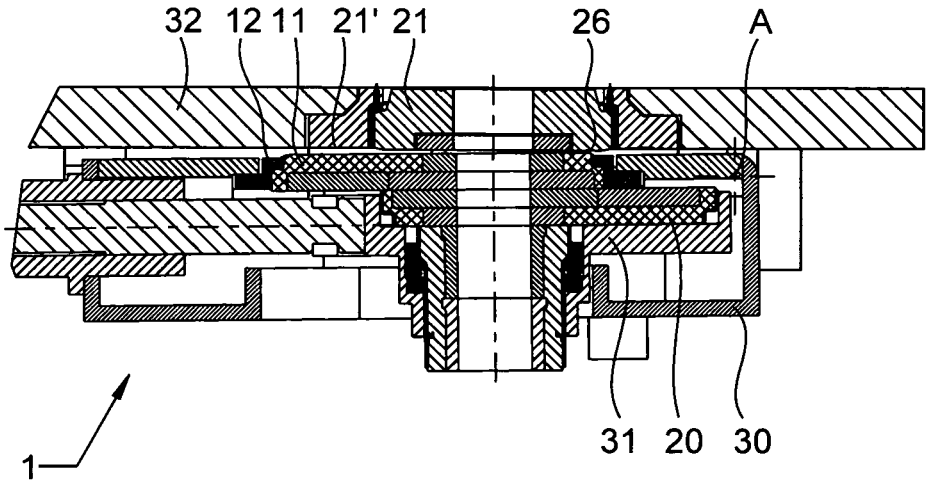
FIG. 5 is a longitudinal section of an exemplary embodiment of a sliding closure upon pivoting onto the spout of a converter.

As already mentioned, the closing plate 10 according to the invention can be accommodated as a stationary base plate in a housing frame 30 of the sliding closure 1 according to FIG. 5 in which housing frame 30 is displaceably disposed a sliding unit 31 with the sliding plate 20, the longitudinal axis L of the closing plate 10 extending in the direction of displacement of the sliding closure 1. The housing frame 30 is removeably attached to a base plate 32 fixed to the receptacle. Preferably suspension means are provided for the pivotable positioning of the housing frame 30 on the base plate 32 fixed to the receptacle, the pivot axis A extending at a right angle to the direction of displacement of the sliding unit 31.

In FIG. 5 it is particularly illustrated how the housing frame 30 with the refractory parts mounted therein are pivoted about the axis A and are then fixed to the base plate 32 using fixing means (not shown), the refractory parts being braced with spring elements provided in the housing frame 30.

With the tapering section 26 according to the invention of the narrow side 16 of the refractory plate 11 lying closer to the pivot axis A, with contact of the base plate with the lower sliding surface 21' of the refractory spout head part 21 fitted in the base plate 32 fixed to the receptacle damage to these refractory parts normally made of ceramic material is largely avoided. As additional security the spring elements are designed with a spring characteristic curve such that initially only very slight contact forces come into contact with this tapered section 26 of the refractory plate 11 striking the head part first before the full spring force takes effect upon the plate 11 resting two-dimensionally on the head part 21.

Figure 6:
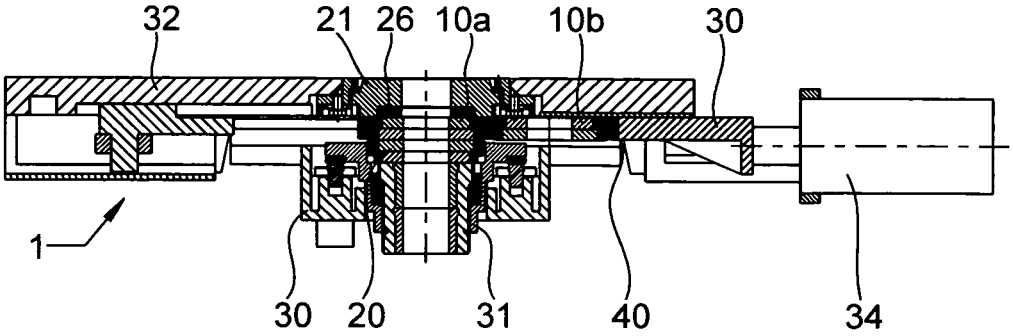
FIG. 6 is a cross-section of the sliding closure according to FIG. 5 with a case located in an initial position and containing two base plates.
Figure 7:
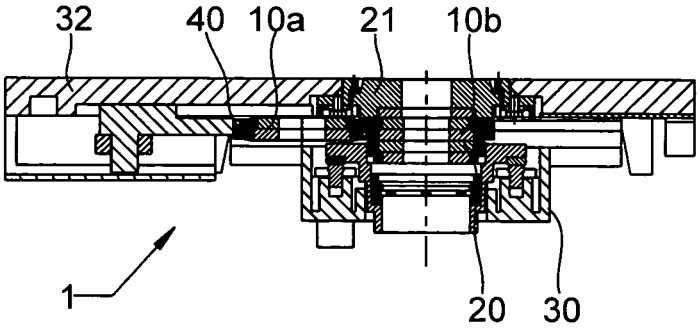
FIG. 7 is a cross-section of the sliding closure according to FIG. 5 with the case in a final position.

With the sliding closure 1 according to FIG. 6 and FIG. 7, the housing frame 30 contains a case 40 displaceable at a right angle to the direction of displacement of the sliding unit 20 with at least two closing plates 10*a*, 10*b* serving as base plates, it being possible to remove the one closing plate 10*a* by displacing the case 40 with a drive 34 from the operating position according to FIG. 6, and replacing it with the other closing plate 10*b* (FIG. 7), without the housing frame 30 having to be dismantled. The precise design and mode of operation of this type of sliding closure can be learnt from the previously mentioned earlier Swiss patent application No. 00603/08, and is therefore not described in detail.

According to the invention the refractory plates 11 of all closing plates 10*a*, 10*b* are provided with tapering sections 28, 29, at least along the longitudinal sides 18, 19 to the front in relation to the case displacement so as to avoid damage with their sliding surfaces during the mutual displacement of the refractory parts braced with one another with full contact force. This risk of striking of the edges arises primarily due to the differences in thickness of the refractory plates and the head part 21 arising due to dimensional tolerances. Preferably, both longitudinal sides 18, 19 of the respective refractory plate 11 are provided with tapering sections 28, 29, in particular if a to and fro displacement of the case 40 is provided for the purpose of simplifying the changeover process.

The closing plate 10 serving as a stationary base plate could by all means also have tapering sections on the sliding surface 14 associated with the sliding plate 20 on the narrow sides 16, 17, or the sliding plate 20 could itself be provided with this type of tapering sections.

This type of sliding plate could also be formed on the side facing away from the sliding surface with a spring known in its own right and so only be provided on the one side with a sliding surface with which within the framework of the invention, for example, on the one narrow side of the sliding surface a tapering section could be provided so that upon pivoting the sliding unit by means of two-dimensional contact, due to this tapering section the sliding plate would not come into contact square on with the base plate.

The invention is illustrated sufficiently by the exemplary embodiments described. It could, however, also be implemented by additional versions. Therefore, the sheet metal jacket 12 surrounding the refractory plate 11 can be a deep-drawn sheet metal, a binding or also a cassette frame or similar.

With a platform with which the outer sides extend at an angle to the longitudinal axis L of the plate or these outer sides are rounded, this tapering section according to the invention with the refractory plate could not be provided over the whole length, but only in a partial section.

The invention claimed is:

1. A closing plate for a sliding closure on a spout of a receptacle for molten metal, comprising:

an elongate refractory plate having first and second opposed sliding surfaces and lateral sides that delimit said first and second sliding surfaces, said refractory plate including at least one tapering section along at least one of said lateral sides that forms an angle ($\alpha$) with said first sliding surface; and a jacket surrounding said lateral sides of said refractory plate and extending up to but not around said at least one tapering section such that said at least one tapering section projects beyond said jacket in a direction toward said first sliding surface.

2. The closing plate of claim 1, wherein said angle ($\alpha$) of each of said at least one tapering section is between 10° and 15°.

3. The closing plate of claim 1, wherein said lateral sides of said refractory plate include two opposed longitudinally extending sides generally parallel to a longitudinal axis of said refractory plate and two opposed narrow sides generally perpendicular to the longitudinal axis of said refractory plate, said at least one tapering section comprising a single tapering section associated with one of said narrow sides of said refractory plate.

4. The closing plate of claim 1, wherein said lateral sides of said refractory plate include two opposed longitudinally extending sides generally parallel to a longitudinal axis of said refractory plate and two opposed narrow sides generally perpendicular to the longitudinal axis of said refractory plate, said at least one tapering section comprising three tapering sections, one of which is associated with one of said narrow sides of said refractory plate and two of which are associated with said longitudinally extending sides of said refractory plate.

5. The closing plate of claim 1, wherein said lateral sides of said refractory plate include two opposed longitudinally extending sides generally parallel to a longitudinal axis of said refractory plate and two opposed narrow sides generally perpendicular to the longitudinal axis of said refractory plate, said at least one tapering section comprising a single tapering section associated with one of said longitudinally extending sides of said refractory plate.

6. The closing plate of claim 1, wherein said lateral sides of said refractory plate include two opposed longitudinally extending sides generally parallel to a longitudinal axis of said refractory plate and two opposed narrow sides generally perpendicular to the longitudinal axis of said refractory plate, said at least one tapering section comprising two tapering sections, each associated with a respective one of said longitudinally extending sides of said refractory plate.

7. The closing plate of claim 1, wherein said refractory plate has an octagonal outer contour.

8. The closing plate of claim 1, wherein said refractory plate is a multi-part refractory plate.

9. The closing plate of claim 1, wherein said jacket is a sheet metal jacket.

10. The closing plate of claim 1, wherein said refractory plate includes a spout opening.

11. The closing plate of claim 1, wherein an outer surface of said at least one tapering section is contiguous with said first sliding surface.

12. A sliding closure on a spout of a receptacle for molten metal, comprising:

a base plate adapted to be fixed to the receptacle;

a refractory spout head part arranged in connection with said base plate;

a housing frame;

said closing plate of claim 1 accommodated as a stationary base plate in said housing frame; and a sliding unit arranged in said housing frame and including a sliding plate, said sliding unit being displaceable relative to said closing plate, said closing plate being arranged relative to said sliding unit such that the longitudinal axis of said closing plate extends in a direction of displacement of said sliding unit.

13. The sliding closure of claim 12, wherein said first sliding surface is braceable against said sliding plate.

14. The sliding closure of claim 12, wherein said lateral sides of said refractory plate of said closing plate include two opposed longitudinally extending sides generally parallel to a longitudinal axis of said refractory plate and two opposed narrow sides generally perpendicular to the longitudinal axis of said refractory plate, said housing frame is pivotable about a pivot axis relative to said base plate and releasably attached to said base plate, the pivot axis extending at a right angle to the direction of displacement of said sliding unit, said at least one tapering section comprising a single tapering section situated along one of said narrow sides of said refractory plate lying closer to the pivot axis.

15. The sliding closure of claim 12, further comprising a case arranged in said housing frame, said case containing two of said closing plates and being displaceable to enable removal of one of said closing plates from an operating position and insertion of another of said closing plates into the operating position.

16. The sliding closure of claim 15, wherein said case is configured such that a direction of displacement of said case extends at a right angle to the direction of displacement of said sliding unit.

17. The sliding closure of claim 16, wherein said lateral sides of said refractory plate of said closing plate include two opposed longitudinally extending sides generally parallel to a longitudinal axis of said refractory plate and two opposed narrow sides generally perpendicular to the longitudinal axis of said refractory plate, said at least one tapering section of said refractory plate of each of said two closing plates comprising two tapering sections each situated along a respective one of said longitudinally extending sides of said refractory plate.

18. The sliding closure of claim 15, wherein said case is displaceable to and fro between an initial position and a final position.

19. The sliding closure of claim 18, wherein said lateral sides of said refractory plate of said closing plate include two opposed longitudinally extending sides generally parallel to a longitudinal axis of said refractory plate and two opposed narrow sides generally perpendicular to the longitudinal axis of said refractory plate, said at least one tapering section of said refractory plate of said closing plate comprising two tapering sections each situated along a respective one of said longitudinally extending sides of said refractory plate.

20. The sliding closure of claim 12, wherein said closing plate is braceable with said second sliding surface against a sliding surface of said refractory spout head part.

* * * * *